US007878422B2

(12) United States Patent
Heiniger et al.

(10) Patent No.: US 7,878,422 B2
(45) Date of Patent: Feb. 1, 2011

(54) VARIABLE DAMPENING RATE SUSPENSION SYSTEM

(75) Inventors: Richard W. Heiniger, Hiawatha, KS (US); Don Patrick Meenen, Hiawatha, KS (US); David C. Benson, Hiawatha, KS (US); James B. Prohaska, Prior Lake, MN (US)

(73) Assignee: Bestway, Inc., Hiawatha, KS (US)

( * ) Notice: Subject to any disclaimer, the term of this patent is extended or adjusted under 35 U.S.C. 154(b) by 254 days.

(21) Appl. No.: 12/200,452

(22) Filed: Aug. 28, 2008

(65) Prior Publication Data

US 2010/0050858 A1 Mar. 4, 2010

(51) Int. Cl.
*B05B 1/20* (2006.01)

(52) U.S. Cl. ..... 239/163; 239/159; 239/160; 239/167; 91/405; 92/85 B

(58) Field of Classification Search ..... 239/159, 239/160, 163, 167; 91/405; 92/85 B
See application file for complete search history.

(56) References Cited

U.S. PATENT DOCUMENTS

| | | | | |
|---|---|---|---|---|
| 4,880,160 | A | 11/1989 | Patterson et al. | |
| 6,234,407 | B1 | 5/2001 | Knight et al. | |
| 6,315,218 | B1 | 11/2001 | Guesdon | |
| 6,776,356 | B2 * | 8/2004 | Maliteare | 239/163 |
| 7,040,552 | B2 * | 5/2006 | McCrea et al. | 239/167 |
| 7,395,663 | B2 * | 7/2008 | Thompson et al. | 60/403 |

* cited by examiner

*Primary Examiner*—Dinh Q Nguyen
(74) *Attorney, Agent, or Firm*—Law Office of Mark Brown, LLC; Mark E. Brown

(57) ABSTRACT

A variable rate suspension system for a boom sprayer including a lift assembly and chassis. The suspension system includes a needle valve fluidly connected to a hydraulic accumulator and a first and second lift arm cylinder. A control block provides hydraulic fluid to the system and lift arm cylinders. Dampening of vertical accelerations encountered by the chassis and transmitted to the boom sprayer through the lift assembly is controlled by adjusting the rate hydraulic fluid flows from the cylinders into the accumulator using the needle valve.

4 Claims, 4 Drawing Sheets

VARIABLE DAMPENING RATE SUSPENSION SYSTEM

BACKGROUND OF THE INVENTION

1. Field of the Invention

The present invention relates generally to support equipment for an agricultural apparatus, and in particular to a suspension system for a spray boom applicator.

2. Description of the Related Art

Open ground is often treated with various chemicals to effect the growth of vegetation. Agricultural fields are typically treated with either dry or liquid chemicals such as fertilizers, herbicides, fungicides, insecticides, etc. Application of liquid chemicals is frequently accomplished using boom spraying equipment. Boom spraying equipment typically consists of a length of rigid support structure (e.g., a boom sprayer) that is attached to and extends laterally from a vehicle, such as a self propelled or towed terrestrial vehicle. As the boom sprayer traverses the surface of a field, the liquid chemical is ejected from liquid spray nozzles spanning the length of boom. The optimal boom height is determined by such factors as the spray pattern of the nozzle, the material being applied, wind conditions, crop heights, etc.

Applying chemicals using boom sprayers is very effective because utilization of long boom lengths permits application of a precise amount of chemical to a target while minimizing the number of passes the equipment needs to make to treat a given area. Therefore, it is desired for the boom to maintain a fixed height above the target to ensure proper application of the chemical. This results in an economic benefit whereby excessive application of the chemical is minimized, and the task is completed in less time.

Boom sprayers used in agricultural operations are subject to factors that can compromise economic and operational efficiencies. Spraying systems are usually directly attached to a vehicle that travels on the ground being treated by a mechanism that allows for adjustment of the height of the boom sprayer above the target. Often the systems use booms that may extend up to 40 feet from each side of the vehicle, e.g., defining swath widths of up to 90 feet. As a result, when the vehicle encounters irregularities in the surface, the vertical accelerations of the vehicle are transmitted to the boom sprayer through the attachment mechanism. The distal ends of the boom experience high vertical accelerations resulting in a large amplitude of travel beyond the desired height above the target due to their distance from the attachment mechanism and flexing of the supporting structure. The resulting forces put stress upon the vehicle, attachment mechanism, and boom sprayer, causing fatigue and wear of the equipment. Further, vertical movement of the boom sprayer above the target decreases the effectiveness of the application by causing inconsistent application of the chemical.

These problems have been addressed by providing a combination of mechanisms that isolate the movement of the vehicle from the boom. For example, the Thorstensson U.S. Pat. No. 5,373,767 discloses a cushion suspension system for an agricultural tool which utilizes a hydraulic cylinder in conjunction with an air spring to provide dampening of the vertical movement transmitted to the tool caused by movement of the attached vehicle. The Guesdon U.S. Pat. No. 6,315,218 discloses a suspension device for a boom sprayer which utilizes the articulation among rocker arms, link rods, and hydraulic cylinders to dampen the vertical movement of a boom sprayer caused by vertical movement of the vehicle chassis. However, a disadvantage of such combined systems relates to their complexity of implementation and adjustability of performance.

Heretofore there has not been available a variable dampening rate suspension system for a boom sprayer with the advantages and features of the present invention.

SUMMARY OF THE INVENTION

In the practice of the present invention, a variable dampening rate suspension system is provided for equipment attached to a vehicle using a hydraulic system. The suspension system includes a needle valve connected to a hydraulic accumulator and a hydraulic system. The hydraulic system can include a hydraulic fluid supply and one or more hydraulic cylinders for movement of the equipment attached to a vehicle. The variable rate suspension system can be used to dampen forces encountered by the vehicle and transmitted to the equipment by varying the rate hydraulic fluid moves from the hydraulic cylinders into the accumulator.

Adjusting the dampening effect of the suspension system affects the forces that are transmitted from the chassis to the equipment and equipment connectors resulting in more accurate equipment positioning and decreased equipment stresses. A high flow of hydraulic fluid from a hydraulic cylinder through the needle valve and into the accumulator provides a large amount of dampening of forces encountered by the vehicle allowing the equipment to have a softer ride and less movement out of a range of optimal positioning. Alternatively, two needle valves can be used with the suspension system to increase the variability of the dampening effect.

BRIEF DESCRIPTION OF THE DRAWINGS

The drawings constitute a part of this specification and include exemplary embodiments of the present invention and illustrate various objects and features thereof.

DETAILED DESCRIPTION OF THE PREFERRED EMBODIMENTS

I. Introduction and Environment

As required, detailed aspects of the present invention are disclosed herein; however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

II. Preferred Embodiment Suspension System 2

Figure 1:
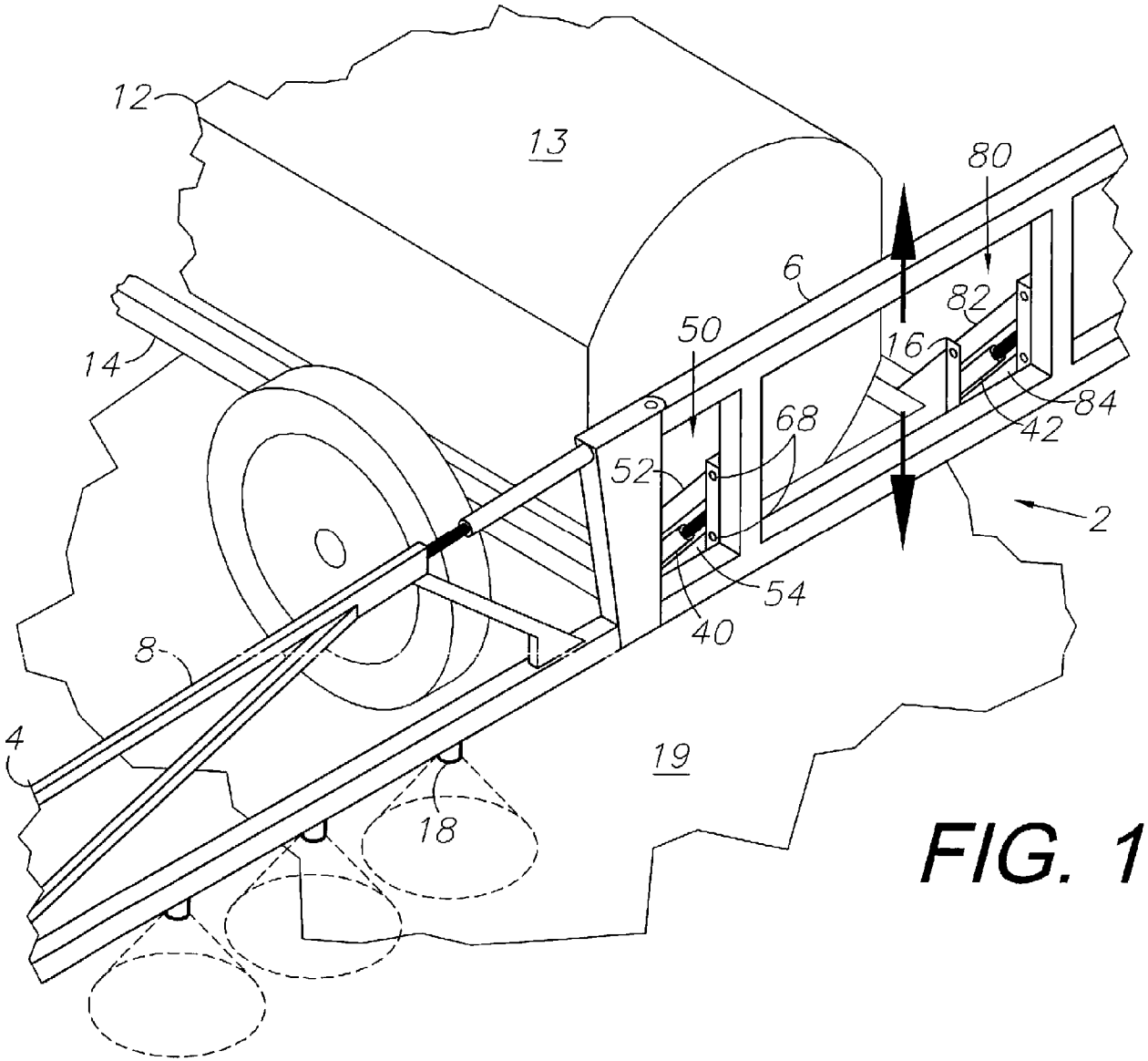
FIG. 1 is a fragmentary, perspective view of a boom sprayer having a suspension system embodying the present invention.

Referring to the drawings in more detail, the reference numeral 2 generally designates a variable rate suspension system for a boom sprayer 4 embodying the principles of the present invention. Without limitation of the generality of useful applications of the suspension system 2, in FIG. 1, the boom sprayer 4 includes a lift frame 6 and a pair of boom wings 8. The lift frame 6 and the boom wings 8 have a plurality of spray nozzles 18 equally spaced along the entire span of the boom sprayer 4 and orientated for application of a substance to a ground surface 19 or vegetation. The elements of the lift frame 6 and the boom wings 8 are generally tubular and can be constructed of lightweight, high-strength composite materials, or of metal.

The lift frame 6 is mounted on the chassis 14 of a vehicle 12, i.e. either a self-propelled or towed sprayer, by means of first and second lift assemblies 50, 80 respectively. The chassis 14 is a structural unit attached to the vehicle 12 for supporting the lift frame 6 and a liquid chemical tank 13. The first lift assembly 50 includes generally parallel first upper and first lower lift arms 52, 54 with a first lift arm push cylinder 40 disposed therebetween. The respective ends of the lift arms 52, 54 are adapted for pivotally connecting to the lower portion of the lift frame 6 at a chassis mount 16. The first lift arm cylinder 40 is connected to the lop of the first lower lift arm 54 at a point near the chassis 14, and to the bottom of the first upper lift arm 52 at a point near the lift frame 6.

Similar to the first lift assembly 50, the second lift assembly 80 includes parallel second upper and second lower lift arms 82, 84 with a second lift arm push cylinder 42 disposed therebetween. The respective ends of the second upper and lower lift arms 82, 84 are adapted for pivotally connecting to the lower portion of the lift frame 6 and a chassis mount 16. The second lift arm cylinder 42 is connected to the top of the second lower lift arm 84 at a point nearest the chassis 14, and to the bottom of the second upper lift arm 82 at a point nearest the lift frame 6. The respective ends of the first and second lift assemblies 50, 80 are coupled to the chassis mounts 16 and the lift frame 6 at lift assembly pivotal connections 68. The chassis mounts 16 are mounted on the upper rear portion of the chassis 14.

The height of the boom sprayer 4 above the ground surface 19 is controlled by the first and second lift arm push cylinders 40, 42 through the hydraulic control block 21. When the boom sprayer 4 is properly positioned, the system 2 is in equilibrium and hydraulic fluid pressure in the push cylinders 40, 42 holds the boom sprayer 4 in its raised operating position. The suspension system 2 functions to variably control the movement of hydraulic fluid in order to adjust the dampening rate as the vehicle 12 rises and falls while traversing uneven terrain and the boom sprayer 4 preferably remains relatively level at a relatively constant height.

Figure 2:
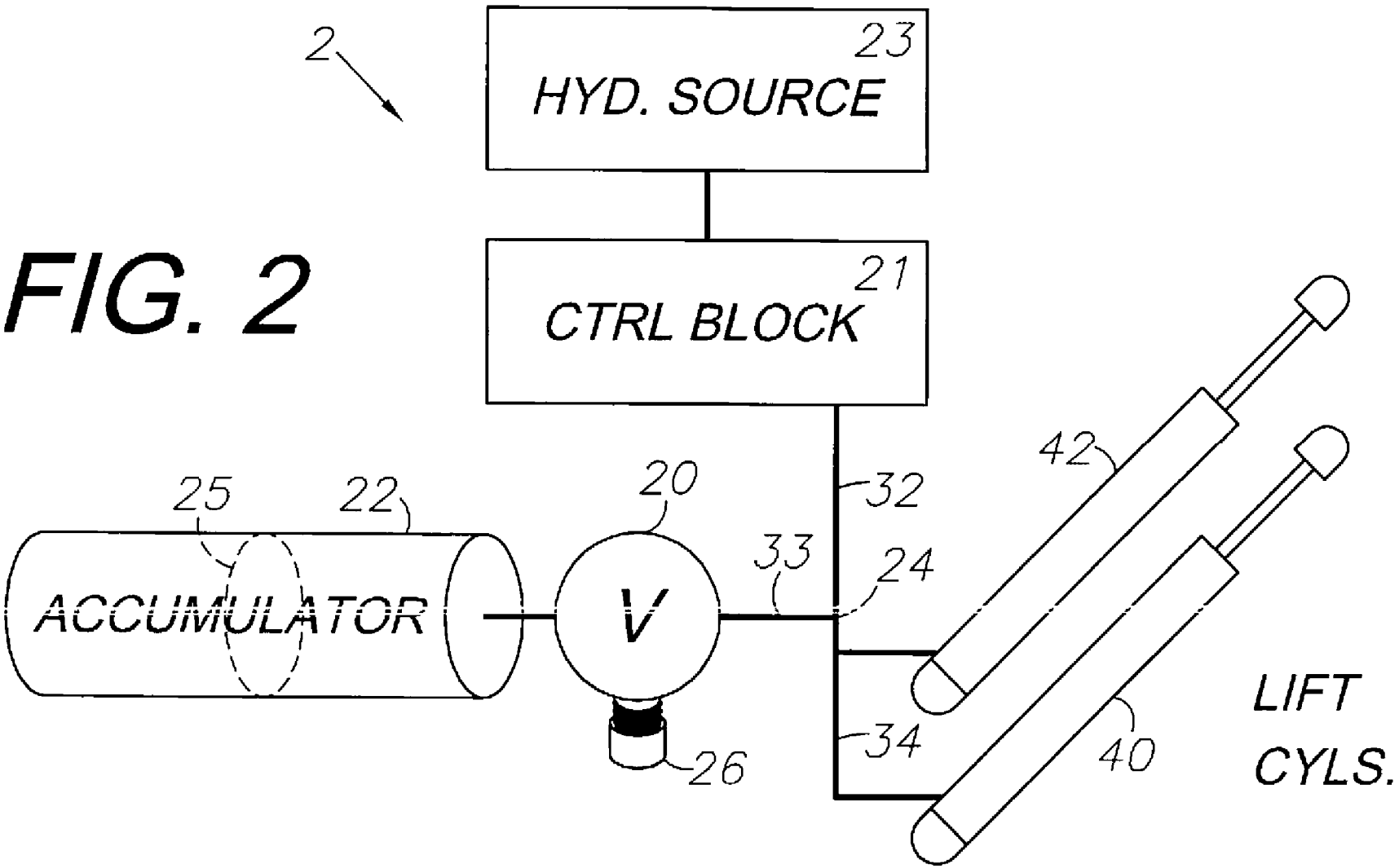
FIG. 2 is a schematic block diagram of the suspension system embodying principles of the present invention.
Figure 3:
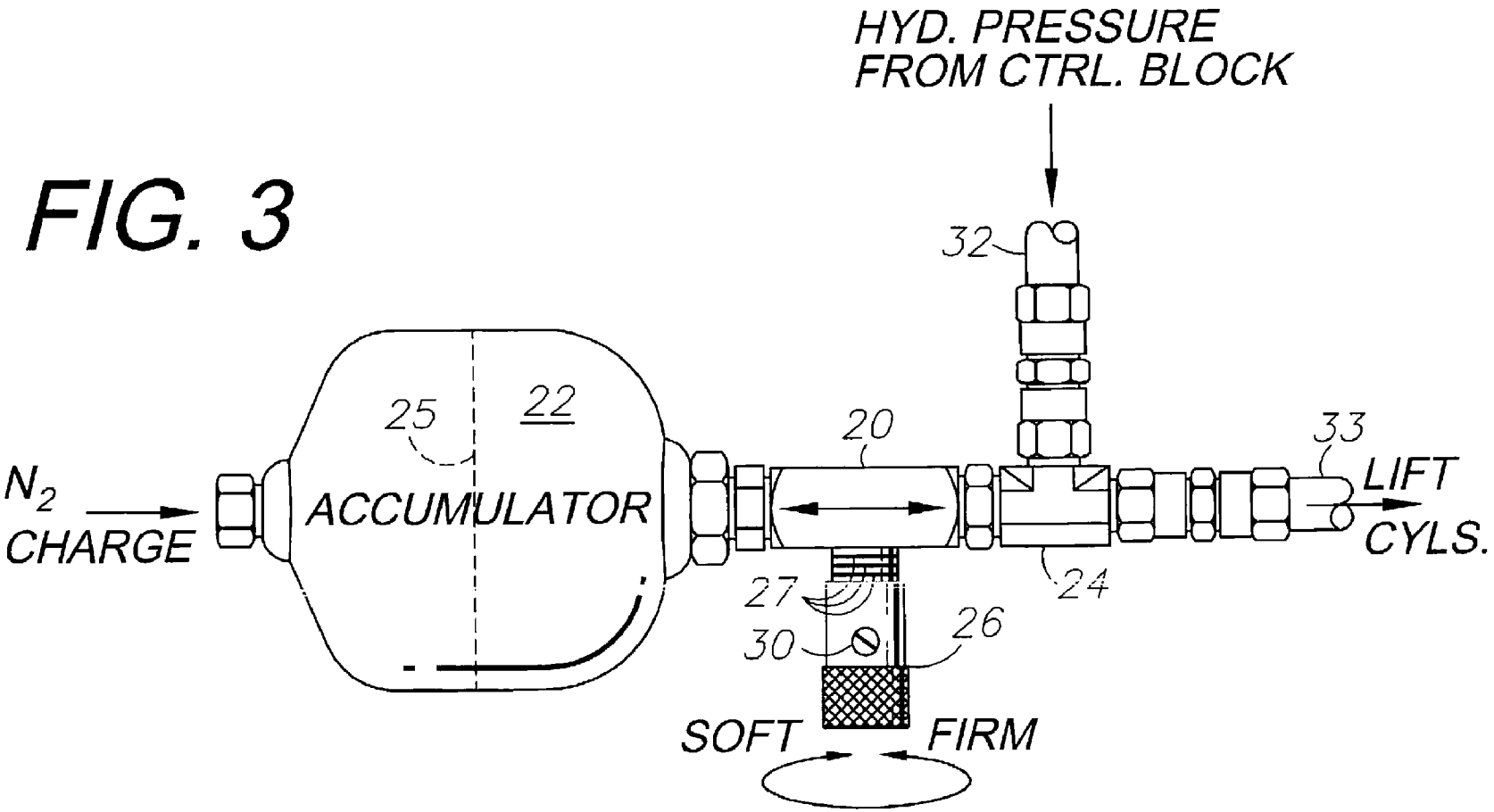
FIG. 3 is an enlarged, fragmented view of the accumulator and needle valve assembly of the present invention.

Referring to FIGS. 2-3, the hydraulic portions of the suspension system 2 generally include am adjustable needle valve 20 disposed between and fluidly connected to an accumulator 22 and a tee tube fitting 24. A hydraulic hose 32 fluidly connects the tee tube fitting 24 with a hydraulic control block 21 receiving hydraulic pressure from a source 23, such as a pump, and thereby providing hydraulic fluid to the suspension system 2, including the first and second lift arm push cylinders 40, 42. The suspension system 2 is fluidly connected to the first lift arm push cylinder 40 by a hydraulic hose 33. Further, the first lift arm push cylinder 40 and the second lift arm push cylinder 42 are fluidly connected by a hydraulic hose 34.

The accumulator 22 is preferably pressurized with $N_2$ and includes a diaphragm 25 with volume and pressure parameters suitable for use with the hydraulic system, e.g., a volume of about 2 liters at a pressure of about 210 PSI. The needle valve 20 includes a knob 26, which variably controls and restricts the flow of hydraulic fluid between the accumulator 22 and the first and second lift arm push cylinders 40, 42. The knob 26 is adjustable between a closed position and an open position as indicated by calibration bands 27, which enable an operator to set the needle valve 20 at predetermined positions corresponding to hydraulic fluid flow restriction rates. Once a desired setting is achieved, a set screw 30 can be engaged for locking the knob 26 in position. Moreover, the calibration bands 27 facilitate resetting the needle valve 20 for predetermined flow rates.

The disposition of the needle valve between obstructed and unobstructed positions restricts movement of hydraulic fluid between the accumulator 22 and first and second lift arm push cylinders 40, 42 thereby creating a dampening effect that varies the independent vertical movement of the chassis 14 and boom sprayer 4. Thus, vertical accelerations encountered by the chassis 14 and transmitted to the boom sprayer 4 via the first and second lift assemblies 50, 80, are dampened by movement of hydraulic fluid between the first and second lift arm push cylinders 40, 42 and the spray boom suspension system 2. As a result, the chassis 14 and the boom sprayer 4 can move independently of one another, limiting the vertical movement of the boom sprayer 4 above the ground surface 19 by dampening the effect of the vertical accelerations encountered by the chassis 14.

The rate at which the hydraulic fluid flows through the needle valve 20 determines the amount of dampening between the boom sprayer 4 and the chassis 14. A low flow rate permits less dampening resulting in a firmer ride for the boom sprayer 4. A high flow rate allows a great deal of dampening resulting in a softer ride for the boom sprayer 4. A soft ride results in the vertical amplitude of the boom sprayer 4 that is less than the vertical amplitude of the chassis 14 due to the forces transmitted to the lift frame 6 being dampened by movement of hydraulic fluid from the first and second lift arm push cylinders 40, 42 through the needle valve 20 and into the accumulator 22. The needle valve 20 is preferably located for easy access by an operator, who can make adjustments in the field to accommodate various equipment configurations and field conditions. It will be appreciated that the hydraulic components, including the lift cylinders 40, 42, the needle valve 20 and the simulator 22 can be designed, sized and adjusted to accommodate the boom sprayer 4, the vehicle 12 and the terrain.

In operation, the needle valve 20 should be at least partly open in order to accommodate surges in hydraulic pressure as the vehicle 12 accelerates vertically. Such accommodation of hydraulic pressure spikes or surges is accomplished by the accumulator 22 and protects the hydraulic components from excessive force. On the other hand, a certain level of flow restriction is preferred in order to prevent unrestricted free flow of fluid between the lift cylinders 40, 42 and the accumulator 22. For example, a needle valve 20 with a maximum flow capacity of approximately 30-60 GPM would accommodate many agricultural sprayer equipment configurations. In operation, operators can relatively easily make field adjustments to adapt particular equipment to terrain surface conditions, which can vary considerably from smooth to heavily rutted. Alternatively, the needle valve 20 can be remotely controlled and equipped with an electric actuator, such as a servomotor, which is controllable by a switch positioned in the vehicle cab.

It will also be appreciated that the suspension system 2 can accommodate various types of equipment, including without limitation boom sprayers. By way of example only and without limitation, other types of equipment which can benefit from variable dampening suspensions include agricultural, construction and mining equipment.

III. Alternative Embodiment Suspension System 102

Figure 4:
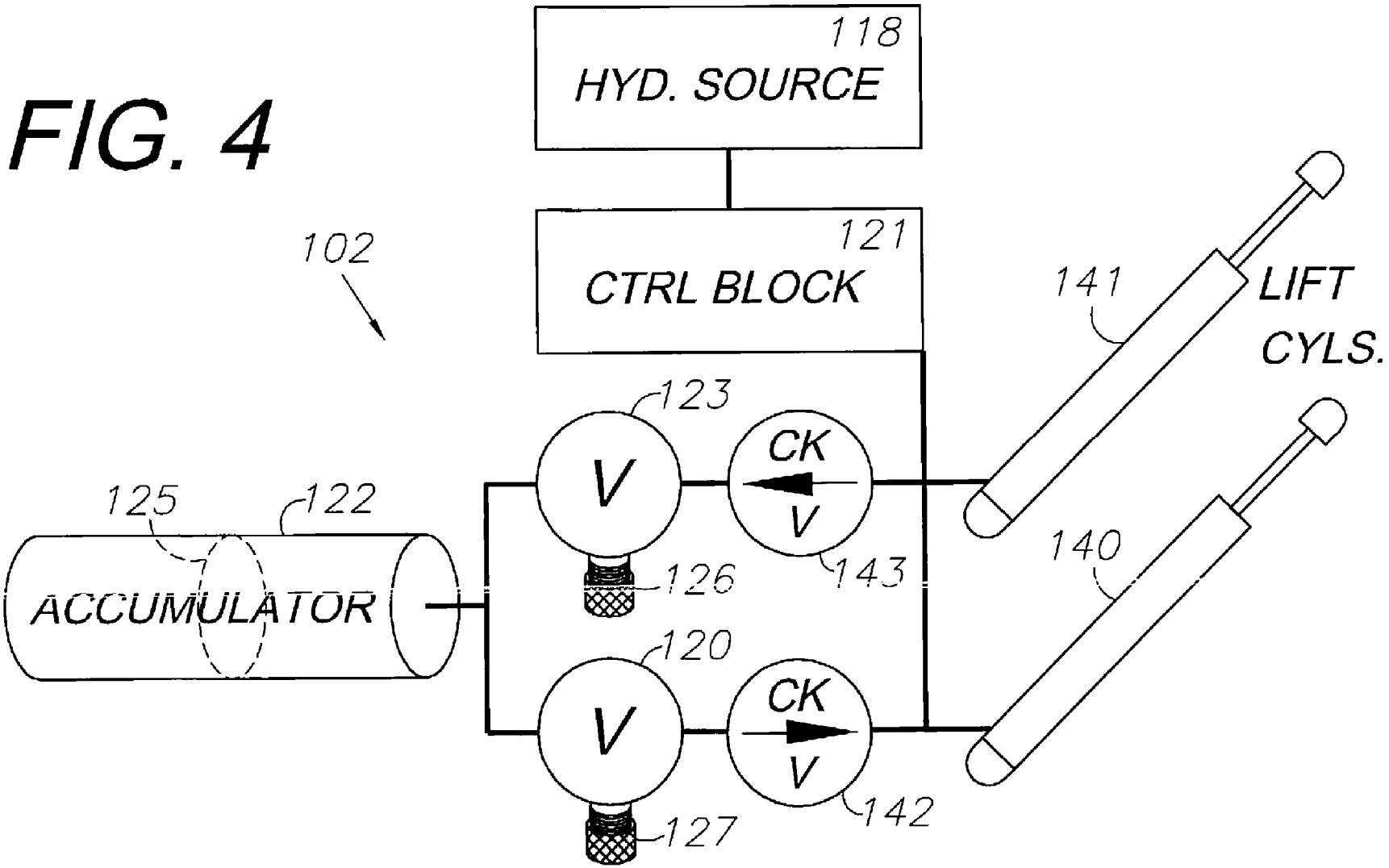
FIG. 4 is a schematic block diagram of a suspension system comprising an alternative embodiment of the present invention with two needle valves.

FIG. 4 shows an alternative embodiment suspension system 102, which is similar to aforementioned suspension system 2 except first and second needle valves 120, 123 are disposed between and fluidly connected to first and second lift arm push cylinders 140, 141 and to a suitably charged diaphragm type hydraulic accumulator 122 with a diaphragm 125. A first check valve 142 is fluidly connected to and disposed between the first needle valve 120 and the first lift arm push cylinder 140, and a second check valve 143 is fluidly connected to and disposed between the second needle valve 123 and the second lift arm push cylinder 141. A hydraulic pressure source 118 connects to the lift arm cylinders 140, 141 via a control block 121. The needle valves 120, 123 have knobs 126, 127 respectively for adjusting the flow of hydraulic fluid into the accumulator 122. The use of a two needle valve arrangement with one check valve each allows for independent control of compression and rebound of the first and second lift arm push cylinders 140, 141 resulting in increased variability of the dampening effect. For example, the second compression-controlling needle valve 123 can be relatively open (minimal restriction) in order to accommodate sudden hydraulic surges from obstacles encountered by the vehicle 12, whereas the first or rebound-controlling needle valve 120 can be more restrictive to gradually settle the boom sprayer 4 back to its normal operating height after the vehicle 12 clears a field obstacle. The needle valves 20, 120, 123 provide operators with considerable control to accommodate uneven field conditions and avoid excessive and potentially destructive boom movements, such as oscillations initiated by driving over uneven terrain.

It will be appreciated that the components of the suspension system 2 can be used for various other applications. For example, the suspension system 2 can be used in an environment where equipment is attached to a vehicle and adjustable using a hydraulic system. Moreover, the suspension system 2 can be fabricated in various sizes and from a wide range of suitable materials, using various manufacturing and fabrication techniques. Further, the suspension system 2 can be mounted on a variety of other vehicles, such as a pickup truck, high-clearance vehicle, trailer, etc.

It is to be understood that while certain aspects of the invention have been shown and described, the invention is not limited thereto and encompasses various other embodiments and aspects.

Having thus described the invention, what is claimed as new and desired to be secured by Letters Patent is:

1. A variable dampening rate suspension system for a vehicle and a boom sprayer vertically movably mounted on the vehicle and oriented transversely to a direction of travel of the vehicle, which suspension system includes:

a hydraulic system with a hydraulic pressure source;

a pair of lift assemblies each including upper and lower lift arms with proximate and distal ends, each lift arm being connected at its proximate end to said vehicle and at its distal end to said boom sprayer;

each said lift assembly including a hydraulic lift cylinder connected to the vehicle and the boom sprayer and adapted for vertically moving the boom sprayer relative to the vehicle structure by extending and retracting;

a diaphragm-type hydraulic accumulator connected to the hydraulic pressure source and the lift cylinder; and a hydraulic flow restrictor valve disposed between and fluidly connected to the accumulator and the lift cylinder for variably restricting flow therebetween;

said flow restrictor valve being adjustable between closed and open positions and providing for variable flow rates of hydraulic fluid therethrough;

said flow restrictor valve comprising a needle valve including an adjustment knob and adapted for providing a firmer ride in a more closed position and a softer ride in a more open position; and a control block connected to said hydraulic pressure source, said lift cylinder and said restrictor valve, said control block controlling hydraulic fluid flow from said pressure source to said lift cylinder and said restrictor valve.

2. The suspension system of claim 1, which includes:

said needle valve being manually operable from a position external to said vehicle.

3. The suspension system of claim 1, which includes:

said needle valve being electrically actuated by remote control.

4. The suspension system of claim 1, which includes:

said restrictor valve comprising a first restrictor valve;

a second restrictor valve comprising a needle valve including an adjustment knob and fluidly connecting said control block, said lift cylinders and said accumulator in parallel with said first restrictor valve;

a first check valve in series with said first restrictor valve, said control block and said lift cylinders;

the second check valve in series with said second restrictor valve, said control block and said lift cylinders; and said check valves being oppositely oriented.

* * * * *